United States Patent [19]

Hradel et al.

[11] 3,947,301

[45] Mar. 30, 1976

[54] AMMONIUM NITRATE EXPLOSIVE COMPOSITION

[75] Inventors: Joseph R. Hradel, Mt. Pleasant, Mich.; Harold E. Staadt, Tulsa, Okla.

[73] Assignee: The Dow Chemical Company, Midland, Mich.

[22] Filed: Jan. 5, 1959

[21] Appl. No.: 784,881

[52] U.S. Cl. ..... 149/43; 86/20 R; 149/15; 149/19.1; 149/21; 149/44; 149/46; 149/114

[51] Int. Cl.[2] ..... C06B 33/04

[58] Field of Search ..... 52/14, 15; 149/43, 44, 149/46

[56] References Cited

UNITED STATES PATENTS

| | | | |
|---|---|---|---|
| 1,301,646 | 4/1919 | Burrows | 149/39 X |
| 1,661,203 | 3/1928 | Toniolo | 423/396 X |
| 1,992,217 | 2/1935 | Kirst et al. | 149/46 X |
| 2,836,484 | 5/1958 | Steng et al. | 149/42 |
| 2,860,041 | 11/1958 | Griffith, Jr. et al. | 149/58 |
| 2,867,172 | 1/1959 | Hradel | 149/92 X |

*Primary Examiner*—Leland A. Sebastian
*Attorney, Agent, or Firm*—Bruce M. Kanuch

EXEMPLARY CLAIM

1. An explosive slurry composition comprising a substantially saturated solution of ammonium nitrate, and suspended solids in said solution to form said slurry, said solids being comprised of at least 50 parts by weight of ammonium nitrate, and not more than 50 parts by weight of finely divided metallic aluminum of character such as to increase the sensitivity of said composition to detonation, the total nitrate comprising at least 50% of the total composition, said composition including water comprising at least 3 percent by weight of the total composition. 2. An ammonium nitrate explosive composition consisting essentially of particulate ammonium nitrate in admixture with an aqueous solution saturated with respect to ammonium nitrate, and with up to 35 per cent by weight of an inorganic sensitizer which taken alone is a stable solid at a temperature of at least 100°C., the amount of water being from 3 to 25 per cent by weight of the total composition. 3. The aqueous ammonium nitrate explosive composition as in Claim 2 in which the inorganic sensitizer is a particulated light metal selected from the group consisting of magnesium, magnesium-base alloys, aluminum, aluminum-base alloys and mixtures thereof.

16 Claims, No Drawings

AMMONIUM NITRATE EXPLOSIVE COMPOSITION

This invention relates to an improved ammonium nitrate explosive composition and more particularly concerns an aqueous ammonium nitrate explosive composition.

It has been a desideratum in the explosives art to formulate and compound explosive compositions which are easily and safely loaded into a borehole or fissure in an earth formation which are of relatively low cost and which do not produce toxic substances on detonation.

Accordingly it is an object of this invention to provide an ammonium nitrate explosive mixture in the form of an aqueous composition which may be readily loaded as by pumping the composition into a borehole or by first placing the composition, if pasty, in rigid or flexible containers and positioning the containers in a borehole, the aqueous composition having substantially no voids therein and especially when in the form of a slurry the composition further filling any confining space in the manner of a liquid so as to generally eliminate voids below the surface of the slurry.

It is another object of the invention to provide an ammonium nitrate explosive composition which can be prepared from low cost materials.

It is another object of the invention to provide an ammonium nitrate explosive composition compounded from substances which do not produce toxic products when the composition is detonated.

It is a still further object of the invention to provide an ammonium nitrate explosive composition which is readily compounded at or near the site where it is used.

These and other objects are attained upon admixing ammonium nitrate and water in suitable proportions, hereinafter described, whereby there is obtained a paste or slurry of particulated ammonium nitrate in its saturated aqueous solution.

The compositions of the invention may be compounded by first preparing an aqueous solution of ammonium nitrate from water and any grade of ammonium nitrate such as fertilizer grade ammonium nitrate or explosives grade ammonium nitrate, and slurrying therein or mixing therewith a particulated ammonium nitrate. However, a most economical procedure is that of admixing a particulated ammonium nitrate with one of the aqueous ammonium nitrate solutions of commerce such as an aqueous solution containing about 84 percent of ammonium nitrate as obtained in the manufacture of ammonium nitrate.

While a fine particulate grade of ammonium nitrate may be used to obtain a composition with somewhat greater work potential, it is generally more economical to use an inexpensive grade such as fertilizer grade ammonium nitrate in either prilled or granular form and, if necessary, to increase the size of the load slightly. However, though a relatively coarse grade of ammonium nitrate may be employed a grade of ammonium nitrate having more than about 5 percent of particles of a size greater than that passing about a 10 mesh sieve (U.S. Sieve Series) is to be avoided as decreasing the sensitivity of the composition to initiation to an undesirably low level.

The components of the invention may be combined in proportions varying from about 50 to 97 percent of ammonium nitrate and from about 3 to 25 percent of water to produce a pasty to pumpable two phase composition, one of the phases being solid ammonium nitrate, the other an aqueous solution saturated with respect to ammonium nitrate. It is to be understood that while compositions in this range will under room temperature conditions contain both dissolved ammonium nitrate and solid phase particulate ammonium nitrate, the relative amount of ammonium nitrate in each phase is determined by the temperature of the mixture under equilibrium conditions. At higher temperatures more solid particulate ammonium nitrate will be taken into solution than at lower temperatures.

While such an aqueous composition of ammonium nitrate explosive is detonable upon initiation by a suitable heavy initiator, it is generally to be preferred that the slurry be admixed with up to about 35 percent of a sensitizer to increase sensitivity as well as work potential. Suitable sensitizers include light metals such as magnesium and magnesium-base alloys comprising at least 80 percent of magnesium, and aluminum and aluminum-base alloys comprising at least 80 percent of aluminum, the light metal being in particulated form. Atomized pellets of light metal as well as the ground flake form of metal may be used in compounding the explosive composition of the invention. Examples of suitable magnesium-base alloys include those having the ASTM designations ZK10, ZK60, AZ41, as well as AZ11 containing 1 percent of manganese, ZK60 containing 2 percent of thorium, and an alloy containing 2.8 percent of aluminum, 8.4 percent of zinc, the balance magnesium. While the particulated metals may be used in the form of ground or flaked particles a desirable form is that of atomized pellets, for example, atomized metal pellets obtained as described in U.S. Pat. Nos. 2,699,576 and 2,728,107.

Ground metals as produced are generally quite varied in particle size and usually contain a substantial amount of fines passing a 325 mesh sieve. Not only are these fines rather easily ignited in air but they contribute to low level initiation of particulate ammonium nitrate in admixture therewith. Such fines are thus unsuitable in the preparation of relatively insensitive ammonium nitrate explosive mixtures. Ground metals may be used upon separating the fines as by screening and selecting particles about 85 percent of which are retained on a 140 mesh sieve and not more than 1 percent of which pass a 200 mesh sieve. It is also desirable to reject coarse metal particles not passing a 20 mesh sieve as these are too large to react effectively during the brief interval of the detonation reaction of ammonium nitrate, though the presence of a small percent of larger particles does not particularly adversely affect detonability of an ammonium nitrate explosive mixture.

On the other hand atomized metal pellets produced according to the U.S. patents referred to above are readily formed in a narrow range of particle sizes with little fines. While the same limits of metal particle sizes generally apply whether the metal is ground or pelletized the following is a sieve analysis of a suitable pelletized magnesium-base alloy having the ASTM designation ZK60.

Table 1

| Number of Sieve Passed | Number of Sieve Retained on | Percent Retained |
|---|---|---|
| 20 | 35 | 22 |
| 35 | 48 | 38 |

Table 1-continued

| Number of Sieve Passed | Number of Sieve Retained on | Percent Retained |
|---|---|---|
| 48 | 65 | 27 |
| 65 | 100 | 10 |
| 100 | pan | 3 |

Other suitable sensitizers for the present explosive composition include finely divided carbon, preferably passing a 325 mesh sieve, and mixtures of carbon and the above-mentioned particulate light metals. It is to be preferred that the carbon-particulate metal mixtures contain at least 50 to 75 percent by weight of the particulate metal.

Additional sensitizers which may be used include such inorganic salts as potassium nitrate, sodium nitroprusside, potassium ferrocyanide, ammonium chromate, potassium nitrite, strontium nitrate, sodium cyanide, calcium nitrate and ammonium hypophosphite all of which contain nitrogen and exhibit a melting point or decomposition point above a temperature of 100° C. These inorganic sensitizers are best employed in the explosive composition of the invention in the range of about 15 to 35 percent by weight of the total composition.

If desired the explosive composition of the invention may be thickened upon admixing therewith from about 0.1 to 5 percent based on the weight of the liquid phase, of a thickening agent such as methyl cellulose or gum karaya. Other suitable thickening agents are carboxymethyl cellulose, kava kava gum, guar gum, accroides gum, locust bean gum, balsam tolu natural, Irish moss, and Iceland moss.

Compositions of the invention containing from about 3 to 12 percent of water are generally possessed of a paste-like consistency and are more conveniently loaded into accessible boreholes.

Compositions of the invention containing from about 12 to 25 percent of water are generally pumpable as a slurry and are useful in loading inaccessible or horizontal or upwardly sloping boreholes.

In preparing and detonating the composition of the invention, the ingredients of the composition are mixed together in small quantities as by kneading in a plastic bag or in larger quantities as with a mechanical agitator or paddle mixer. A load or charge of the so-prepared mixture is placed in the desired location, usually in the confinement of a borehole. A shaped charge such as a jet perforator containing a charge of RDX, is placed next to the load armed with a suitable initiator for the shaped charge, such as a No. 8 Electric Blasting Cap. The shaped charge is oriented with respect to the explosive load so that the firing axis is directed toward the load, preferably its mid-point. The electrical lead from the blasting cap is rigged to a time controlled firing mechanism or run to a remote control device and, if desired, a sand or gravel tamp is placed over the load and initiator. The load is then fired upon setting off the blasting cap and shaped charge.

The composition of the invention prepared and detonated as described is especially advantageously used in mining operations in which the use of low cost compositions combining the properties of good heave or work potential with lower range brisance and low toxicity is to be desired.

To demonstrate the properties of the ammonium explosive mixture of the invention, various embodiments of the invention were prepared and tested. In each test a 10 or a 25 pound quantity of explosive mixture was formulated of a particulated fertilizer grade ammonium nitrate and water, with or without particulated aluminum metal, in the proportions and amounts shown in the table. The individual proportions were in each case mixed in a separate polyethylene plastic bag of sufficient size to readily hold the quantity prepared. The various components of the mixture were weighed into the bag, the bag closed and the contents mixed together by kneading the bag with the hands. The fertilizer grade ammonium nitrate contained about 0.7 percent of wax, 1 percent of diatomaceous earth and 0.3 percent of chalk. The particle size of the ammonium nitrate was such that 94 percent by weight of the particles passed a 20 mesh sieve and 85 percent by weight were retained on a 100 mesh sieve. The aluminum metal was in the form of atomized pellets. The particle size of the particulated aluminum was such that about 0.4 percent passed a 40 mesh sieve, about 85 percent was retained on 200 mesh sieve and about 0.9 percent passed a 325 mesh sieve.

The prepared mixtures were loaded into individual shallow bore holes drilled in clay soil and having a diameter of 4 inches and a depth of about 4 feet. Successive boreholes were spaced about 20 feet apart. The loading of each hole was accomplished by first placing an initiator in the form of a shaped charge armed with a blasting cap in the bottom of the hole and running the lead wires of the blasting cap to a firing control switch. Each shaped charge was used and positioned with the jet end or firing axis facing upwardly. The explosive mixtures contained in the plastic bags in which they were mixed were placed in respective test holes, the bag in each case deforming so as to cover the initiator. Sand was used as a tamp, the hole being filled from the bag to ground level with sand. Detonation of the mixture was attampted by closing the firing switch thus setting off the initiator at the bottom of the hole. In a comparison test in the form of a blank, one hole was loaded solely with a 10 pound quantity of fertilizer grade of ammonium nitrate and an initiator.

The magnitudes of the detonations obtained were determined by measuring the size of the crater produced. While the crater size alone is not indication of the amount of earth formation that is broken up or loosened, it does give an indication of the work potential of the mixture detonated. The crater size herein reported shows how much material was thrown sufficiently so as not to fall back over the test hole. Test conditions and results are summarized in the Table 2.

In order to compare the composition of the invention with conventional explosives varied amounts of 60 percent dynamite each with a No. 8 Electric Blasting Cap therefor were placed in shallow testholes 4 feet deep, tamped with sand and detonated. 5 Pounds of dynamite so loaded and detonated produced a crater 5 feet in diameter and 1.5 feet deep; 10 pounds of dynamite produced a crater 8 feet in diameter and 1 foot deep; while 25 pounds of dynamite produced a crater 11 feet in diameter and 5 feet deep. The results of the blank, Test No. 15, show that ammonium nitrate alone is not detonable under these conditions.

Table 21

| Test No. | Composition FGAN % | $H_2O$ % | Al % | Weight of Load, Lbs. | Indicator Blasting Cap No. | Wt. of RDX in Shaped Charge, Oz. | Crater Dimenions, Ft. Diameter | Depth |
|---|---|---|---|---|---|---|---|---|
| 1 | 97 | 3 | — | 10 | 8 | 3.25 | 10 | 6 |
| 2 | 92 | 8 | — | 10 | 8 | 3.25<br>3.25 | heaved and cracked 3 ft. | tamp only |
| 3 | 85 | 7.5 | 7.5 | 10 | 8 | 3.25 | 6 | 4.5 |
| 4 | 70 | 15 | 15 | 10 | 8 | 3.25 | 6 | 3 |
| 5 | 80 | 10 | 10 | 10 | 8 | 3.25 | 5 | 1.5 |
| 6 | 55 | 15 | 30 | 10 | 8 | 3.25 | 8 | 3 |
| 7 | 60 | 25 | 15 | 10 | 8 | 3.25 | 8 | 4 |
| 8 | 87 | 3 | 10 | 25 | 8 | 1 | 12 | 3 |
| 9 | 85 | 5 | 10 | 25 | 8 | 1 | 12 | 3 |
| 10 | 80 | 10 | 10 | 25 | 8 | 1 | 12 | 3 |
| 11 | 90 | 5 | 5 | 10 | 8 | 3.25 | 10 | 4 |
| 12 | 75 | 5 | 20 | 10 | 8 | 3.25 | 10 | 6 |
| 13 | 70 | 3 | 27 | 10 | 8 | 3.25 | 10 | 5 |
| 14 | 60 | 5 | 35 | 10 | 8 | 3.25 | 10 | 6 |
| 15 | 100 | — | — | 10 | 8 | 1.75 | — | — |

FGAN = fertilizer grade of ammonium nitrate
RDX = trimethylene trinitramine

In an additional test an explosive load weighing about 4 pounds and having the composition 50 percent of ammonium nitrate, 20 percent of water, and 30 percent of particulated aluminum was used to fill a 3 by 12 inch steel pipe nipple which was capped on both ends and laid on the ground. The load was initiated by a shaped charge, containing 3.25 ounces of RDX, which was positioned at one end of the pipe nipple so as to fire longitudinally into the pipe nipple. The resulting detonation destroyed the pipe nipple.

The compositions of the invention possess the additional advantage that they are little affected by a moist environment and can even tolerate a moderate amount of connate water.

We claim:

1. An explosive slurry composition comprising a substantially saturated solution of ammonium nitrate, and suspended solids in said solution to form said slurry, said solids being comprised of at least 50 parts by weight of ammonium nitrate, and not more than 50 parts by weight of finely divided metallic alluminum of character such as to increase the sensitivity of said composition to detonation, the total nitrate comprising at least 50% of the total composition, said composition including water comprising at least 3 percent by weight of the total composition.

2. An ammonium nitrate explosive composition consisting essentially of particulate ammonium nitrate in admixture with an aqueous solution saturated with respect to ammonium nitrate, and with up to 35 per cent by weight of an inorganic sensitizer which taken alone is a stable solid at a temperature of at least 100°C. the amount of water being from 3 to 25 per cent by weight of the total composition.

3. The aqueous ammonium nitrate explosive composition as in claim 2 in which the inorganic sensitizer is a particulated light metal selected from the group consisting of magnesium, magnesium-base alloys, aluminum, aluminum-base alloys and mixtures thereof.

4. The aqueous ammonium nitrate explosive composition as in claim 3 in which the particulated light metal is selected from the group consisting of magnesium and magnesium-base alloys comprising at least 80 per cent of magnesium.

5. The aqueous ammonium nitrate explosive composition as in claim 3 in which the particulated light metal is selected from the group consisting of aluminum and aluminum-base alloys comprising at least 80 per cent of aluminum.

6. An aqueous ammonium nitrate explosive composition consisting essentially of an admixture of from about 50 to 97 per cent by weight of ammonium nitrate, from 12 to 25 per cent by weight of water, and up to 35 per cent by weight of an inorganic sensitizer which taken alone is a stable solid at a temperature of at least 100°C., the composition being further characterized by the pressure of solid particulate ammonium nitrate in equilibrium with a saturated aqueous solution thereof.

7. An aqueous ammonium nitrate explosive composition consisting essentially of an admixture of from about 53 to 97 per cent by weight of ammonium nitrate, from 3 to 12 per cent by weight of water, and up to 35 per cent by weight of an inorganic sensitizer which taken alone is a stable solid at a temperature of at least 100°C., the composition being further characterized by the presence of solid particulate ammonium nitrate in equilibrium with a saturated aqueous solution thereof.

8. An aqueous ammonium nitrate explosive composition as in claim 2 in which the inorganic sensitizer is a mixture of finely divided carbon and a solid particulated light metal selected from the group consisting of magnesium, magnesium-base alloys, aluminum, aluminum-base alloys, and mixtures thereof.

9. An explosive composition consisting essentially of particulate ammonium nitrate in admixture with 1 to 4 per cent by weight particulate aluminum and 3 to 6 per cent by weight water based on the total composition.

10. An explosive composition consisting essentially of particulate ammonium nitrate in admixture with a small amount of particulate aluminum of the order of 5 weight per cent and 3 to 6 per cent by weight water based on the total composition.

11. An explosive composition consisting essentially of particulate ammonium nitrate in admixture with a minor amount of particulate aluminum and 3 to 6 per cent by weight water based on the total composition.

12. An explosive composition consisting essentially of particulate ammonium nitrate in admixture with a minor amount of particulate aluminum and 1 to 6 per cent by weight water based on the total composition.

13. An explosive slurry composition comprising a substantially saturated aqueous solution of ammonium nitrate in sufficient quantity to form a slurry, a substantial quantity of solid inorganic nitrate above that normally soluble in said saturated solution, and finely divided metallic aluminum suspended in said slurry as the primary sensitizing agent in sufficient quantity to substantially increase sensitivity of the composition to detonation, the total nitrate comprising at least 50 per cent of the total composition.

14. An explosive composition in slurry form, comprising a suspension of solids in an aqueous solution in which the water is substantially saturated with inorganic nitrate, said suspended solids comprising undissolved particulate inorganic nitrate and particulate aluminum, the inorganic nitrate being ammonium nitrate, the said particulate inorganic nitrate comprising at least 50 per cent by weight of the total suspended solid inorganic nitrate and metal, the ratio of total inorganic nitrate to metal in the overall composition being within the range 9/0.5 to 1/1, and the metal being sufficient in quantity at least to sensitize said slurry to detonation by a small high detonation pressure booster.

15. An explosive composition comprising water in porportions of not less than 3 per cent by weight and sufficient to form a slurry as distinguished from a solid mass, said water being substantially fully saturated with inorganic nitrate salt, a further quantity of inorganic nitrate salt being suspended in particulate solid form in said saturated water, said nitrate being ammonium nitrate, and a sufficient quantity of particulate metallic aluminum also suspended in said saturated water to sensitize said composition to detonation by a small high detonation pressure booster, the quantity of aluminum being not greater than the solid nitrate.

16. An explosive composition in slurry form which comprises, as principal ingredients, an ammonium nitrate saturated aqueous solution, and solid matter comprising 30 to 85 parts by weight of particulate ammonium nitrate and 5 to 35 parts of particulate metallic aluminum, the saturated aqueous solution being sufficient in quantity to hold said solid matter in suspension, wherein the aluminum is the primary sensitizing agent for the slurry, the total nitrate comprising at least 50% of the total composition.

* * * * *

UNITED STATES PATENT OFFICE

CERTIFICATE OF CORRECTION

Patent No. 3,947,301 Dated March 30, 1976

Inventor(s) Joseph R. Hradel et al.

It is certified that error appears in the above-identified patent and that said Letters Patent are hereby corrected as shown below:

In the "References Cited" on cover page, "Steng" should read -- Streng --.

Column 2, lines 14 and 15, "suitable" should read -- suitably --.

Column 4, line 42, "attampted" should read -- attempted --.

In the Table, in columns 5 and 6, change the Table number to -- 2 -- instead of "21";

In the heading over the last two columns, "Dimenions" should read -- Dimensions --.

Column 6, Claim 6, line 30, "pressure" should read -- presence --.

Column 7, Claim 15, line 22 "porportions" should read -- proportions --.

Signed and Sealed this

Twenty-first Day of December 1976

[SEAL]

*Attest:*

RUTH C. MASON
*Attesting Officer*

C. MARSHALL DANN
*Commissioner of Patents and Trademarks*